US007642480B2

(12) United States Patent
Ozil et al.

(10) Patent No.: US 7,642,480 B2
(45) Date of Patent: Jan. 5, 2010

(54) ACTUATING THE CONTACTS OF AN INTERRUPTING CHAMBER IN OPPOSITE DIRECTIONS VIA AN INSULATING TUBE

(75) Inventors: Joel Ozil, St Andre de Corcy (FR); Christophe Creusot, Miribel (FR); Jean-Luc Bourgeois, Lyons (FR); Yannick Kieffel, St Jean de Bournay (FR)

(73) Assignee: Areva T&D SA, Paris la Defense Cedex (FR)

( * ) Notice: Subject to any disclaimer, the term of this patent is extended or adjusted under 35 U.S.C. 154(b) by 273 days.

(21) Appl. No.: 11/973,796

(22) Filed: Oct. 9, 2007

(65) Prior Publication Data

US 2008/0083704 A1 Apr. 10, 2008

(30) Foreign Application Priority Data

Oct. 9, 2006 (FR) ..... 06 54163

(51) Int. Cl.
*H01H 9/38* (2006.01)
*H01H 33/12* (2006.01)
*H01H 33/66* (2006.01)

(52) U.S. Cl. ..... 218/14; 335/15; 335/57; 335/71; 335/83; 335/97; 335/133; 335/156; 335/196; 335/201; 335/202; 218/13; 218/17; 218/19; 218/20; 218/21; 218/53; 218/59; 218/62; 218/63; 218/64; 218/65; 218/68; 218/92; 218/155; 200/258

(58) Field of Classification Search ..... 335/15, 335/57, 71, 83, 97, 133, 156, 196, 201–202; 218/13–14, 17, 19–21, 53–68, 89–92, 155; 200/258

See application file for complete search history.

(56) References Cited

U.S. PATENT DOCUMENTS 2,448,695 A * 9/1948 Van Ryan ..... 335/17

(Continued)

FOREIGN PATENT DOCUMENTS

EP 0029085 A1 5/1981

(Continued)

OTHER PUBLICATIONS

French Preliminary Search Report, FA 685133—FR 0654163 (Mar. 8, 2007) pgs. 3.

*Primary Examiner*—Elvin G Enad
*Assistant Examiner*—Mohamad A Musleh
(74) *Attorney, Agent, or Firm*—Nixon Peabody LLP

(57) ABSTRACT

In order to reduce the breaking energy of a high-voltage or medium-voltage circuit-breaker, the interrupting chamber (10) contains two contacts (12, 14) mounted to move in opposite directions, and actuated via a single device (20). The two contacts (12, 14) are surrounded by an insulating casing (18) of tubular shape, coupled in fixed manner to the main contact (12). The contacts (12, 14) are actuated by a device having a lever (24) in which each lever arm is coupled to a link, one of the links (32) being secured to the insulating casing (18) and the other link (34) being secured to the second contact (14). The guiding of the drive tube (18) on the main contacts (12*b*, 14*b*) makes it possible to improve breaking by keeping clean gas between said main contacts.

17 Claims, 1 Drawing Sheet

U.S. PATENT DOCUMENTS

| | | | | | |
|---|---|---|---|---|---|
| 2,909,633 | A | * | 10/1959 | Umphrey | 218/91 |
| 3,238,340 | A | * | 3/1966 | Lerch | 218/63 |
| 3,300,610 | A | * | 1/1967 | Roth et al. | 218/91 |
| 3,527,912 | A | * | 9/1970 | Jaillet | 218/66 |
| 3,659,065 | A | * | 4/1972 | Roidt et al. | 218/84 |
| 3,955,057 | A | * | 5/1976 | Dabringhausen et al. | 218/63 |
| 4,182,942 | A | * | 1/1980 | Koyanagi et al. | 218/57 |
| 4,459,447 | A | * | 7/1984 | Arimoto | 218/56 |
| 4,577,073 | A | * | 3/1986 | Talpo | 218/59 |
| 4,604,508 | A | * | 8/1986 | Talpo | 218/47 |
| 6,013,888 | A | * | 1/2000 | Thuries | 218/14 |

FOREIGN PATENT DOCUMENTS

| | | | |
|---|---|---|---|
| EP | 0809269 | A2 | 11/1997 |
| EP | 0822565 | B1 | 2/1998 |
| EP | 1032009 | A2 | 8/2000 |

* cited by examiner

ACTUATING THE CONTACTS OF AN INTERRUPTING CHAMBER IN OPPOSITE DIRECTIONS VIA AN INSULATING TUBE

CROSS-REFERENCE TO RELATED PATENT APPLICATION OR PRIORITY CLAIM

This application claims the benefit of a France Patent Application No. 06 54163, filed on Oct. 9, 2006, in the France Intellectual Property Office, the disclosure of which is incorporated herein in its entirety by reference.

DESCRIPTION

1. Technical Field

The present invention relates to circuit-breakers for high-voltage or medium-voltage, in which the drive energy is reduced by means of the contacts moving in opposite directions.

More particularly, the invention relates to actuating the contacts of an interrupting chamber of a circuit-breaker in opposite directions via an insulating tube surrounding the contacts, e.g. by means of a lever.

2. State of the Prior Art

Switchgears for medium voltage or high voltage comprise a pair of contacts mounted to move relative to each other between a closed position in which the electric current can flow and an open position in which the electric current is interrupted.

The speed of separation of the contacts is one of the main parameters for guaranteeing the dielectric performance of the circuit-breaker on opening. In order to reduce the drive energy required, while also increasing the speed of separation of the contacts, in particular during breaking performed by a circuit-breaker, it has been proposed to design two moving contacts that are mounted to move relative to each other and that are actuated via a single drive member.

By convention, the term "main contact" is used to designate an electrical contact (with its anti-corona cap) via which the rated current passes the term "moving contact" is used to designate the main and arcing contact assembly that is connected directly to the drive member. The "oppositely moving contact", also made up of a main contact and of an arcing contact, is moved via a linkage, which is itself connected to the moving contact.

In particular, Document EP 0 822 565 describes a circuit-breaker for high voltage or medium voltage that has a lever having two arms, one arm being connected to a nozzle secured to or integral with a first contact and the other arm being connected to a second contact, that lever making it possible for the movement of the first contact to drive the second contact simultaneously in the opposite direction.

Instead of a two-arm lever system, the system for transmitting the drive in a different direction can be implemented by a belt or chain looped around two pinions: see Document FR 2 774 503.

It appears however that, during breaking of high currents, hot gases can be projected to the vicinity of the main contacts. The presence of such hot gases can give rise to dielectric arcing; that type of arcing can be destructive for the circuit-breaker.

In general, management of such hot gases leads to overdimensioning of the circuit-breaker. Unfortunately, circuit-breaker compactness remains a major cost factor.

SUMMARY OF THE INVENTION

Among other advantages, the invention proposes mitigating the above-described drawbacks, and both implementing a double-action system for the contacts and also protecting the main contacts effectively from the hot gases generated by breaking.

To this end, an insulating tube is inserted into the interrupting chamber, around the main contacts. By means of this presence, a volume of "clean" dielectric gas, e.g. SF6 or CF4, is maintained around said contacts during triggering of the circuit-breaker, thereby making it possible to preserve good dielectric properties. Thus, the presence of the tube makes it possible to eliminate arcs re-striking between the main contacts, in spite of the compactness of the circuit-breaker, which, for example, has an insulator of small diameter.

Although the insulating tube has at least these two functions, it nevertheless remains a force transmission system that is very simple; it is implemented such that it is secured to a moving first contact, and it is the insulating tube that, during triggering, drives the second contact (or oppositely moving contact) so as to move it in the opposite direction via a connection to actuation means.

In one of its aspects, the invention thus provides an interrupting chamber for a high-voltage or medium-voltage circuit-breaker, said interrupting chamber containing first and second contacts mounted to move along an axis in opposite directions relative to each other, and surrounded by a tube that is made of an insulating material, and that extends longitudinally along the translation axis. Each of the moving contacts can comprise a "main" contact and an arcing contact; for example, the main contact and the arcing contact of the oppositely moving second contact can slide relative to each other.

The insulating tube is fastened to a first contact, preferably to the main contact thereof, and is connected to actuation means so that the triggering of the circuit-breaker and the subsequent movement of the contact serve to drive the actuation means. The actuation means are also connected via connection means to the second contact, so that the tube moving in one direction drives the second contact in the opposite direction.

Advantageously, the first contact is associated with a blast nozzle, and the interrupting chamber is filled with dielectric gas.

Preferably, the insulating tube is guided in translation, in particular relative to the main contacts, e.g. in gastight manner, so that the hot gases cannot penetrate between the contacts. Similarly, gastight guiding between the blast nozzle and the main contact of the oppositely moving second contact makes it possible to guarantee that there is a volume of clean dielectric gas around the main contacts. Breaking performance can thus be improved.

The insulating tube can be made of different materials, and in particular it can comprise arrangements of fibers in a resin. The material of the tube can also be filled so that the tube can then also act as a field distributor.

Preferably, the actuation means are in the form of one or more levers mounted to pivot around an axis that advantageously intersects and/or is normal to the axis of movement of the contacts. The connection means can be rigid rods or links connected to the lever arms, and the dimensioning of the lever arms can be adjusted to optimize the speed ratio between the first contact and the second contact, or even between the main contact and the arcing contact of the same moving contact.

In another aspect, the invention provides a high-voltage or medium-voltage circuit-breaker provided with an interrupting chamber having an insulating tube that takes part in actuating the contacts.

BRIEF DESCRIPTION OF THE DRAWINGS

The characteristics and advantages of the invention can be better understood on reading the following description and on examining the accompanying drawing which is given merely by way of non-limiting illustration, and in which.

DETAILED DESCRIPTION OF PARTICULAR EMBODIMENTS

Figure 1A:
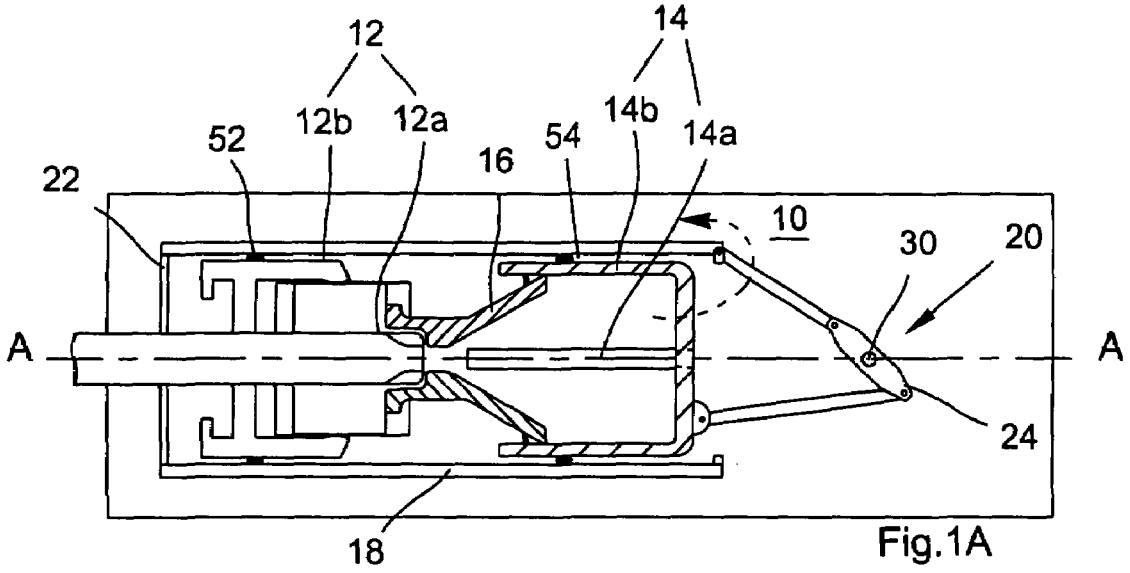
FIGS. 1A and 1B are diagrams of an interrupting chamber with oppositely moving contacts provided with an embodiment of an actuation device of the invention, shown respectively in the open position and in the closed position.
Figure 1B:
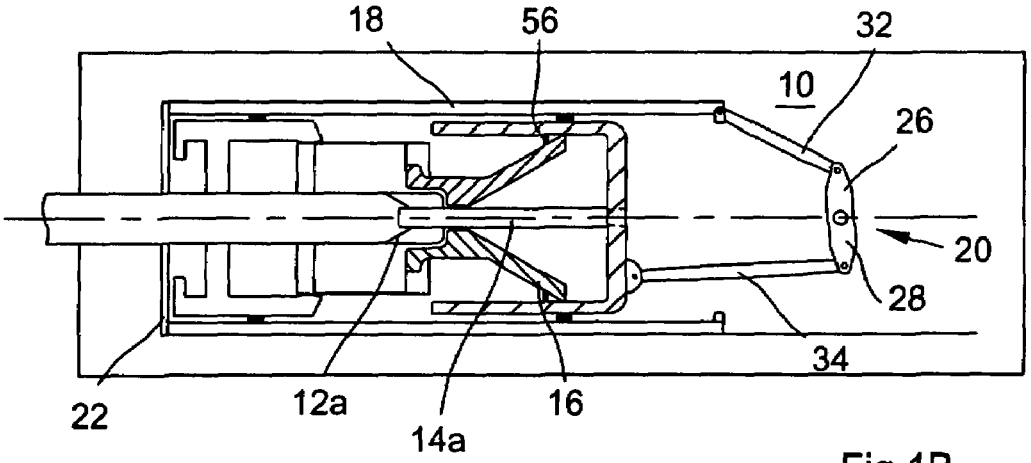
Figure 2:
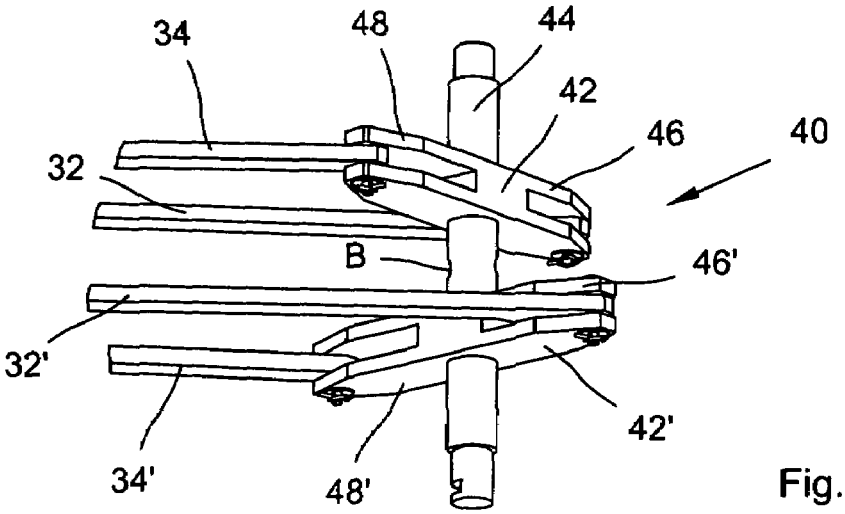
FIG. 2 shows actuation and link means that are part of a preferred embodiment of the invention.

A high-voltage or medium-voltage circuit-breaker includes an interrupting chamber 10 which can be filled with a dielectric gas of the SF6 type. The interrupting chamber 10 contains a moving first contact 12 made up of an arcing contact 12*a* and of a main contact 12*b*, and an oppositely moving second contact 14 made up of an arcing contact 14*a* and of a main contact 14*b*. These two elements co-operate between an open position (FIG. 1A) in which the two contacts 12, 14 are separated from each other and a closed position (FIG. 1B) in which they allow electrical current to pass between them.

During the breaking procedure, the two contacts 12, 14 move in opposite directions the two main contacts 12*b*, 14*b* separate, and then the arcing contacts 12*a*, 14*a* separate, after a latency period, if any, generated by the length of their plug-in, forming an electric arc that is extinguished by the contacts 12, 14 subsequently being moved further apart.

The first contact 12 (even though, in particular in the claims, it could be the second contact 14) is usually secured to a nozzle 16 which is made of an insulating material and which itself extends a gas compression volume. This dielectric nozzle 16 serves as a blast nozzle for blasting the gas coming from the compression volume towards the electric arc.

In order to optimize the dielectric gas content while current is being broken, and in order to prevent arcs from re-striking, the two main contacts 12*b*, 14*b* are located in an insulating tube 18, which surrounds them regardless of whether they are in the open position or in the closed position. Advantageously, the walls of said tube 18 are uniform and solid; the tube 18 is preferably a hollow circularly symmetrical cylinder, but it could also be conical or even polygonal in shape.

In particular, the tube 18 can be a hollow cylinder made of a thermoplastic or thermosetting polymer. Among thermosetting polymers, mention can be made, in particular, of the families of unsaturated polyesters, or of phenolic resins, or of epoxy resins in reaction with acid anhydride setting agents, or of polybismaleides, or of vinylester resins among thermoplastic polymers, mention can be made, in particular, of the families of thermoplastic polyesters, or of polyamides, or of polycarbonates, or of phenylene polyoxides, or of polysulfones, or sulfur polyphenylenes, or polyetherketones, or liquid-crystal polymers, or polyimides, or fluorine-containing polymers of the polytetrafluoroethylene (PTFE) type. It is also possible to use a blend or alloy of these materials.

The tube 18 can also be made of an arrangement of fibers, in particular inorganic fibers such as glass fibers or polyester fibers or aramid fibers of the Kevlar™ type, each of which fibers can be in the form of continuous filaments, long fibers (>3 millimeters (mm), short fibers (<3 mm), mats or woven fabrics. Alternatively or additionally, the tube can, locally or throughout, contain particular reinforcement (alumina Al2O3, alumina trihydrate ATH, calcium oxide CaO, magnesium oxide MgO, silica SiO2, wollastonite, calcium carbonate CaCO3, titanium oxide TiO2, compounds based on silicate such as montmorillonites, vermiculites, and kaolin) that are organic or inorganic.

In another embodiment, the hollow cylinder 18 is made up of filamentary windings, in which the angle given to the winding can be in the range 0° to 90° uniformly over the entire cylinder 18 or varying thereover (in which case it is possible to modify the mechanical properties of the cylinder locally). The fibers are pre-impregnated or post-impregnated with resins (the impregnation being performed in a vacuum or otherwise), e.g. with an epoxy resin of the following types: bisphenol A, bisphenol F, or cycloaliphatic. Various reinforcing materials can also be used, such as inorganic fibers such as glass fibers, or polyester fibers or aramid fibbers of the Kevlar™ type, each of which fibers can be in the form of continuous filaments, long fibers (>3 mm), short fibers (<3 mm), mats, or woven fabrics.

In order to protect the fibers from the polluted SF6 and from the decomposition products of SF6, a protective varnish can be deposited, e.g. in a coat that is about 30 micrometers (μm) thick, such as an aliphatic polyurethane or a polyester film.

In both cases (polymer cylinder or arrangement of fibers), the insulating cylinder 18 can be of varying geometrical shape (with local extra thickness). It can also be manufactured with localized injections of fillers, at its surface or in its thickness: in addition to its functions of transmitting movement and of providing protection from hot gases, the insulating cylinder 18 can also be used to provide an additional function of electric field distribution. Thus, the cylinder 18 can include bisphenol A, bisphenol F, or cycloaliphatic epoxy resins with local injection of a filler of the zinc oxide ZnO or titanium oxide TiO2 type, optimizing its electric field distribution function.

In addition, another material can be overmolded onto the inside diameter and/or onto the outside diameter of the cylinder 18, or deposited in a thin layer on its inside diameter and/or on its outside diameter. The layer can be made of a mixture of polymers (thermoplastic or thermosetting) with incorporation of a filler (material that can have a high relative permittivity) of the following types: ZnO, TiO2, or carbon black, the filler content by weight lying in the range 0.1% to 300%, over a thickness lying the range 10 μm to 5 mm.

The two contacts 12, 14 and the nozzle 16 move along the main axis AA of the interrupting chamber 10 of the circuit-breaker. Preferably, the interrupting chamber 10, the nozzle 16, the first and second contacts 12, 14, and the insulating tube 18 are symmetrical around the axis AA.

Each of the contacts 12, 14 is actuated to move away from or towards the other contact via a single actuation system 20; the moving contact 12 being moved during triggering of the circuit-breaker drives the actuation system 20 which moves the oppositely moving contact 14.

In accordance with the invention, the oppositely moving contact 14 is driven via the tube 18: this option makes it possible to offer greater freedom in implementing the actuation means 20 in view of the particularly complex geometrical shapes of the contact members of a high-voltage or medium-voltage interrupting chamber; because of its diameter, the insulating tube 18, makes it possible to transmit a movement over a wide range of drive forces. The tube 18 can remain of small thickness: since it is a cylindrical tube with solid walls, the load is uniformly distributed, and moving the moving first contact 12 and driving the oppositely moving second cylinder 14 do not need the walls of the tube to be thick in order for them to be strong enough, e.g. the tube 18 can have walls of thickness in the range only a few millimeters to a few tens of millimeters.

To this end, the insulating tube 18 is fastened to the contact 12, e.g. via a link pin, and preferably at its end 22 opposite from the actuation device 20. This makes it possible to leave the other end free for connection to the actuation device 20, and optimizes the protection of the main contacts 12*b*, 14*b* with "clean" dielectric gas. The link between firstly the insulating tube 18 and the link pin 22 and secondly the rod 32 can be implemented in various manners: merely by a hole in the cylinder 18 and/or via a metal collar fastened to the cylinder 18 at the end in question, for example.

The actuation means 20 can take various forms known to the person skilled in the art. Advantageously, the actuation means 20 comprise a lever 24 having two arms 26, 28 mounted to pivot around an axis 30. The first arm 26 is connected to the insulating tube 18 (and thus indirectly to the first contact 12). It thus moves in the direction opposite to the direction in which the second arm 28 connected to the second contact 14 moves.

Preferably, the lever 24 is located on the same side as the oppositely moving contact 14, i.e. in the following order: lever 24—oppositely moving contact 14—nozzle 16—moving contact 12—end 22 of the tube 18.

The connection between the tube 18 and the first arm 26 is preferably implemented by a first rigid rod 32; advantageously the connection is achieved by inserting a pivot at an end portion of the arm 26, and by a rotary fastening at the end of the tube 18, e.g. by a pin.

Similarly, a link, or a second rigid rod 34 pivotally connects an end portion of the second arm 28 to the contact 14.

Depending on the desired movement and depending on the preferred speed ratio, the connection at the oppositely moving contact 14 can be situated at various distances from the axis AA of movement. Similarly, the arms 26, 28 of the lever 24 can be of identical length or of different lengths. In one embodiment, the combined length of the two arms 26, 28 is at its maximum, i.e. of the order of the diameter of the insulating tube 18, in order to optimize the forces.

It is possible to provide slots for connecting the connection rods 32, 34, in particular at the lever 24, if a latency time is recommended between starting to move each of the two contacts 12, 14: e.g. the second connection rod 34 of the oppositely moving contact 14 can move over a certain distance by sliding in a slot (not shown) in the second arm 28 before starting to move in translation along the axis AA.

Similarly, when the oppositely moving contact 14 comprises an arcing contact 14*a* and a main contact 14*b*, it is possible for these two elements 14*a*, 14*b* to be mounted to slide relative to each other, and thus for them to have different strokes and different speeds. The arcing contact 14*a* and the main contact 14*b* are then connected to the actuation system via another connecting rod and another lever (not shown).

In another embodiment, optionally in combination with the preceding embodiments, the axis 30 of the lever 24 is orthogonal to the axis AA of movement, so that the ends of the arms 26, 28 and thus the connection links 32 34 move in a plane, thus making it possible for them to be subjected to less stress at their anchor points. Advantageously, for reasons of symmetry and of ease of assembly, the axis 30 of the lever intersects the axis AA of movement.

In order to improve the guiding of the moving cylinder 18, and in particular in order to reduce the radial forces to zero, in another embodiment, the actuation means 40 comprise two levers 42, 42' whose pivot axes 44 coincide. The pivot axis 44 is normal to the axis AA of movement, and intersects it at a point B. Preferably, the system 40 is axially symmetrical: the two levers 42, 42' are of identical shape and of identical type, and they are located at the same distance from the point B.

The first arm 46, 46' of each lever 42, 42' is connected via a first rod 32, 32' to the tube 18, preferably at two diametrically opposite points. Similarly, two second rods 34, 34' connect the second contact 14 to the second arms 48, 48'. The arms of the levers 42, 42' are preferably not aligned along the axis 44.

In order to improve the guiding of the moving cylinder 18, in another alternative (and optionally in combination), the insulating tube 18 is advantageously guided in translation. For example, a mechanical guide system 52, 54 couples the tube 18 to at least one of the main contacts 12*b*, 14*b*. Preferably, the guiding 52, 54 is gastight: this makes it possible to prevent the hot gases that are generated from penetrating between the permanent contacts 12*b*, 14*b*. It is also preferred for the oppositely moving main contact 14*b* and the blast nozzle 16 to be guided, e.g. by a gastight system 56, so that a volume of clean dielectric gas is guaranteed around the main contacts 12*b*, 14*b*. Each guide system can be a continuous ring or a split ring, of small thickness, made of an insulating material having a low coefficient of friction (e.g., a PTFE filled or otherwise). Thus, the breaking performance is improved.

Other actuation or guide means can be devised. In accordance with the invention, by means of the presence of an insulating tube external to the contacts, design options are open and easier to implement. In addition, the overall radial size remains in the same proportions as in the state of the art, and the overall longitudinal size is not increased, while the protection of the contacts during breaking of high currents is increased.

The invention claimed is:

1. An interrupting chamber for a high-voltage or medium-voltage circuit-breaker, said interrupting chamber containing at least:

first and second contacts mounted to move along an axis and moving in opposite directions relative to each other, between a closed position in which they are in mutual contact and an open position in which they are separated;

a tube made of an insulating material, extending longitudinally along the axis, and coupled in fixed manner to the first contact, the two contacts being located inside the tube regardless of their positions;

actuation means making it possible to actuate the two contacts;

first connection means secured to the tube and to the actuation means; and second connection means secured to the second contact (14) and to the actuation means;

so that, on being operated, the actuation means cause the tube and the second contact to move in translation in opposite directions.

2. An interrupting chamber according to claim 1, in which the first contact comprises an arcing contact and a main contact.

3. An interrupting chamber according to claim 2, further containing a mechanical guide system for guiding the insulating tube in translation along the main contact of the first contact.

4. An interrupting chamber according to claim 1, further containing a nozzle made of an insulating material and coupled in fixed manner to the first contact.

5. An interrupting chamber according to claim 4, in which the second contact comprises an arcing contact and a main contact.

6. An interrupting chamber according to claim 4, in which the second connection means comprise two rods secured to the actuation means and respectively to the main contact and to the arcing contact, so that the arcing contact and the moving contact of the second contact slide relative to each other.

7. An interrupting chamber according to claim 4, further containing a mechanical guide system for mechanically guiding the insulating tube in translation along the main contact of the second contact.

8. An interrupting chamber according to claim 4, further containing a second guide system for providing guiding between the blast nozzle and the main contact of the second contact.

9. An interrupting chamber according to claim 3, in which at least one guide system is gastight, so that the hot gases cannot penetrate, and/or as to guarantee that there is volume of clean gas around the main contacts.

10. An interrupting chamber according to claim 1, in which the actuation means comprise a two-arm lever mounted to pivot around an axis, so that, when the lever pivots around its axis, the first and second contacts move in translation in opposite directions along the axis of the chamber.

11. An interrupting chamber according to claim 10, in which the pivot axis of the lever is orthogonal to the axis of the chamber.

12. An interrupting chamber according to claim 10, in which the pivot axis of the lever intersects the axis of the chamber.

13. An interrupting chamber according to claim 1, in which the actuation means comprise a plurality of levers mounted to pivot about the same axis, each lever being coupled to respective first connection means and to respective second connection means for connection respectively to the tube and to the second contact.

14. An interrupting chamber according to claim 1, in which the connection means comprise a rod connected at one end to the tube or to the second contact and at its other end to the actuation means.

15. An interrupting chamber according to claim 1, in which the insulating material of the tube comprises an arrangement of fibers.

16. An interrupting chamber according to claim 1, in which the insulating material of the tube comprises a filled resin so that the tube also has an electric field distribution function.

17. A high-voltage or medium-voltage circuit-breaker having an interrupting chamber according to claim 1.

* * * * *